US010436454B2

(12) United States Patent
Crudo et al.

(10) Patent No.: US 10,436,454 B2
(45) Date of Patent: Oct. 8, 2019

(54) UP-AND-DOWN HOOD

(71) Applicant: Faber S.p.A., Fabriano (AN) (IT)

(72) Inventors: Alexander Giuseppe Crudo, Fabriano (IT); Simone Biocco, Fabriano (IT); Simone Celli, Pescara (IT)

(73) Assignee: FABER S.P.A., Farbriano (Ancona) (IT)

( * ) Notice: Subject to any disclaimer, the term of this patent is extended or adjusted under 35 U.S.C. 154(b) by 257 days.

(21) Appl. No.: 15/467,298

(22) Filed: Mar. 23, 2017

(65) Prior Publication Data

US 2017/0292717 A1 Oct. 12, 2017

(30) Foreign Application Priority Data

Apr. 8, 2016 (IT) ..... 102016000036516

(51) Int. Cl.
*F24C 15/20* (2006.01)

(52) U.S. Cl.
CPC ..... *F24C 15/2042* (2013.01); *F24C 15/2071* (2013.01); *F24C 15/2085* (2013.01)

(58) Field of Classification Search
CPC ..... F24C 15/2042; F24C 15/2085; F24C 15/2071
USPC ..... 126/299 D, 299 R
See application file for complete search history.

(56) References Cited

U.S. PATENT DOCUMENTS

2004/0099260 A1* 5/2004 Yum ..... F24C 15/2085 126/299 D
2007/0079823 A1* 4/2007 Shin ..... F24C 15/2085 126/299 D
2016/0265790 A1* 9/2016 Dahan ..... F24C 15/2071

FOREIGN PATENT DOCUMENTS

EP 2327936 6/2011
EP 3045822 7/2016

* cited by examiner

*Primary Examiner* — Steven B McAllister
*Assistant Examiner* — Benjamin W Johnson
(74) *Attorney, Agent, or Firm* — Volpe and Koenig, P.C.

(57) ABSTRACT

An extractor hood capable of extracting fumes and/or vapors being generated on a cooking surface, the hood including a first portion (2) integral with a wall (3) of the room where the cooking surface is located, a second portion (4), spaced apart from the first and close to the cooking surface, and a support connection (50) capable of securing the first portion (2) to the second portion (4), the second portion containing a fan (5) capable of extracting fumes and/or vapors from the cooking surface when the hood (1) is in use. The first portion (2) includes an autonomous extraction device capable of extracting fumes and/or vapors exiting the second portion (4) and extracted from the cooking surface by the fan (5) present in the second portion (4), the hood having no connecting tube between the second portion (2) and the first portion (4).

12 Claims, 6 Drawing Sheets

UP-AND-DOWN HOOD

INCORPORATION BY REFERENCE

The following documents are incorporated herein by reference as if fully set forth: Italian Patent Application no. 102016000036516, filed Apr. 8, 2016.

BACKGROUND

This invention relates to an up-and-down extractor hood for a kitchen according to the pre-characterising clause of the main claim.

Hoods of the above-mentioned type usually comprise a portion capable of being arranged near a cooking surface where fumes and/or vapours to be extracted are generated and another fixed portion, placed over said cooking surface and integral with a ceiling or support present above said cooking surface.

For convenience, the "first portion" will indicate the portion integral with the wall and the "second portion" the portion near the cooking surface.

The two portions, which can also be movable in relation to one another, are connected together by a plurality of cables that support the second portion; if the second portion is movable in relation to the first, these cables are subject to the action of an actuator device for their deployment from a support element so as to enable the second portion to be lowered towards the cooking surface and raised up from said surface.

A hood of the type described above is the subject of a previous Italian patent application by the present applicant, filed on 26 Nov. 2009 under No MI2009A002078. In this document, compiled and published as European Patent Application EP2327936, an up-and-down kitchen hood is described wherein the first portion of the hood is integral with a kitchen ceiling and acts as a support for the second portion which has the sole function of extracting, through conventional extraction arrangements contained within said second portion, the fumes and/or vapours produced on the cooking surface. The distance between the first portion and the second portion can be varied and between said portions there may also be a fume duct that can be lengthened or shortened to transfer the fumes and/or vapours extracted by the second portion from the cooking surface towards the first portion.

The latter, in a first embodiment, is connected to a flue to discharge the fumes out of the kitchen where the hood is located. In another embodiment, the first portion operates as an element that reintroduces the air that is extracted from the second portion and reaches said first portion into the kitchen environment, after filtration.

In all of the embodiments of EP2327936, the first portion has no fan or other arrangement for extraction and acts only as a supporting device for the second portion. For this reason, the fumes extracted by the second portion reach the first solely and exclusively by natural convection.

Known hoods are in any case both functional and have a high aesthetic value. They are functional because they come very close to the cooking surface and can extract the fumes and/or vapours from it that are generated during the preparation of food; in the case of a second movable portion, this closeness is achieved only when the extraction function is required.

The above-mentioned hoods also have an aesthetic quality because usually they have particular shapes and characteristics so as not to clearly "bring to mind" their function as extractor hoods; this feature becomes attractive when the hood is not in use and if the second portion is movable, this second portion is brought level with the first one, almost rendering the extractor hood indiscernible.

Known hoods therefore have the necessary cables to support the second portion of the hood, cables which moreover provide power to (or support an appropriate cable to power) a fan located inside said second portion. For this reason these cables have transverse dimensions (or overall dimensions if the above-mentioned cables are wound round them) that are not inconsiderable so as to be clearly visible when the second portion of the hood is brought close to the cooking surface. This represents a drawback from an aesthetic point of view.

SUMMARY

The object of this invention is to offer an extractor hood of the above-mentioned type that has, however, an attractive aesthetic appearance even when it is being used and its second portion is brought close to the cooking surface.

Another objective is to offer an extractor hood of the type described that has an excellent extraction capacity, is extremely safe to use for the users and maintains a high level of reliability over time.

These and other aims that will become clear to the skilled artisan will be achieved by an up-and-down extractor hood according to the accompanying claims.

BRIEF DESCRIPTION OF THE DRAWINGS

For a better understanding of the present invention the following figures are attached, purely by way of non-limiting examples, in which.

DETAILED DESCRIPTION OF THE PREFERRED EMBODIMENTS

Figure 1:
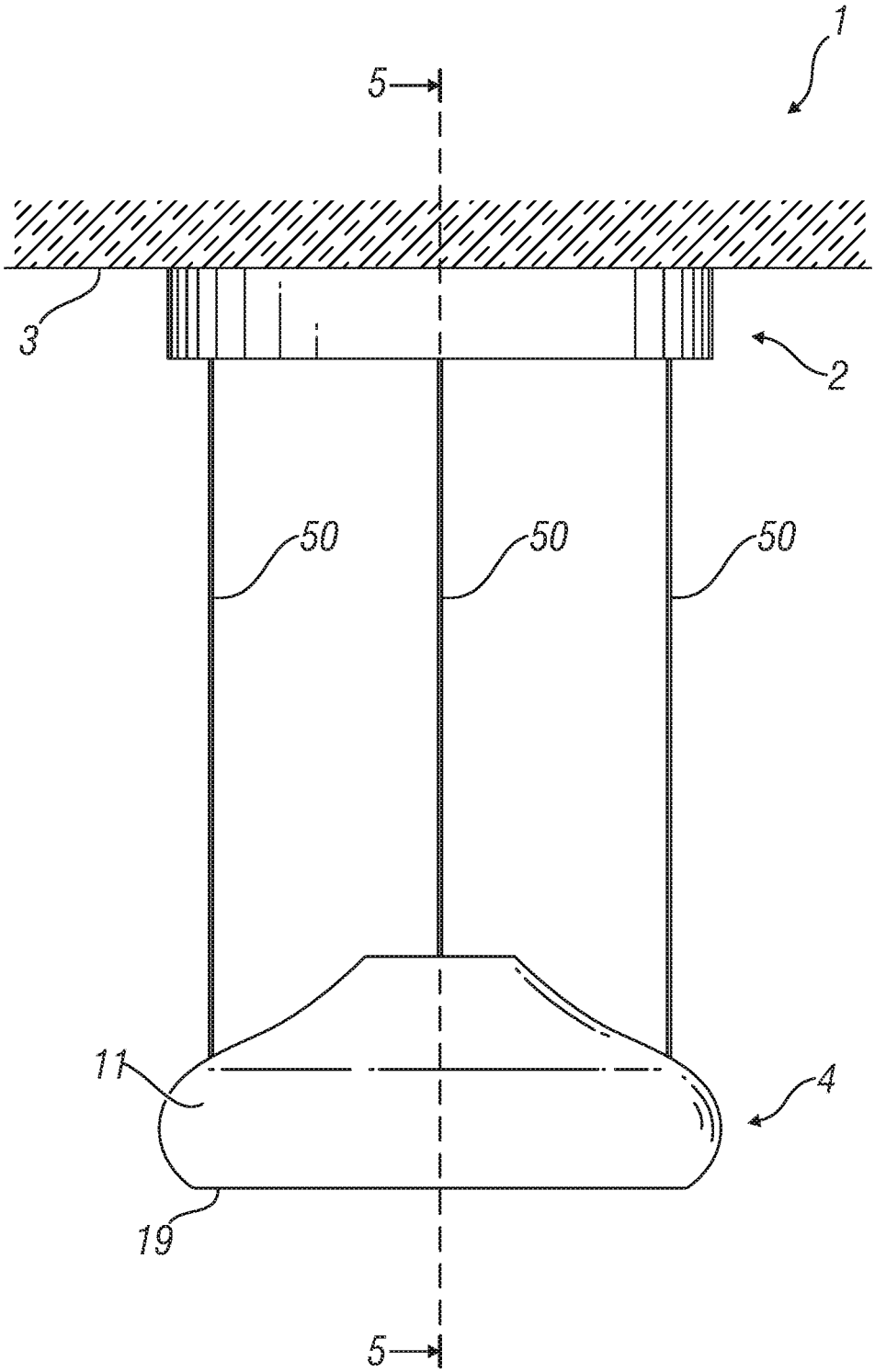
FIG. 1 shows a side view of an extractor hood according to the invention in a position of use.
Figure 2:
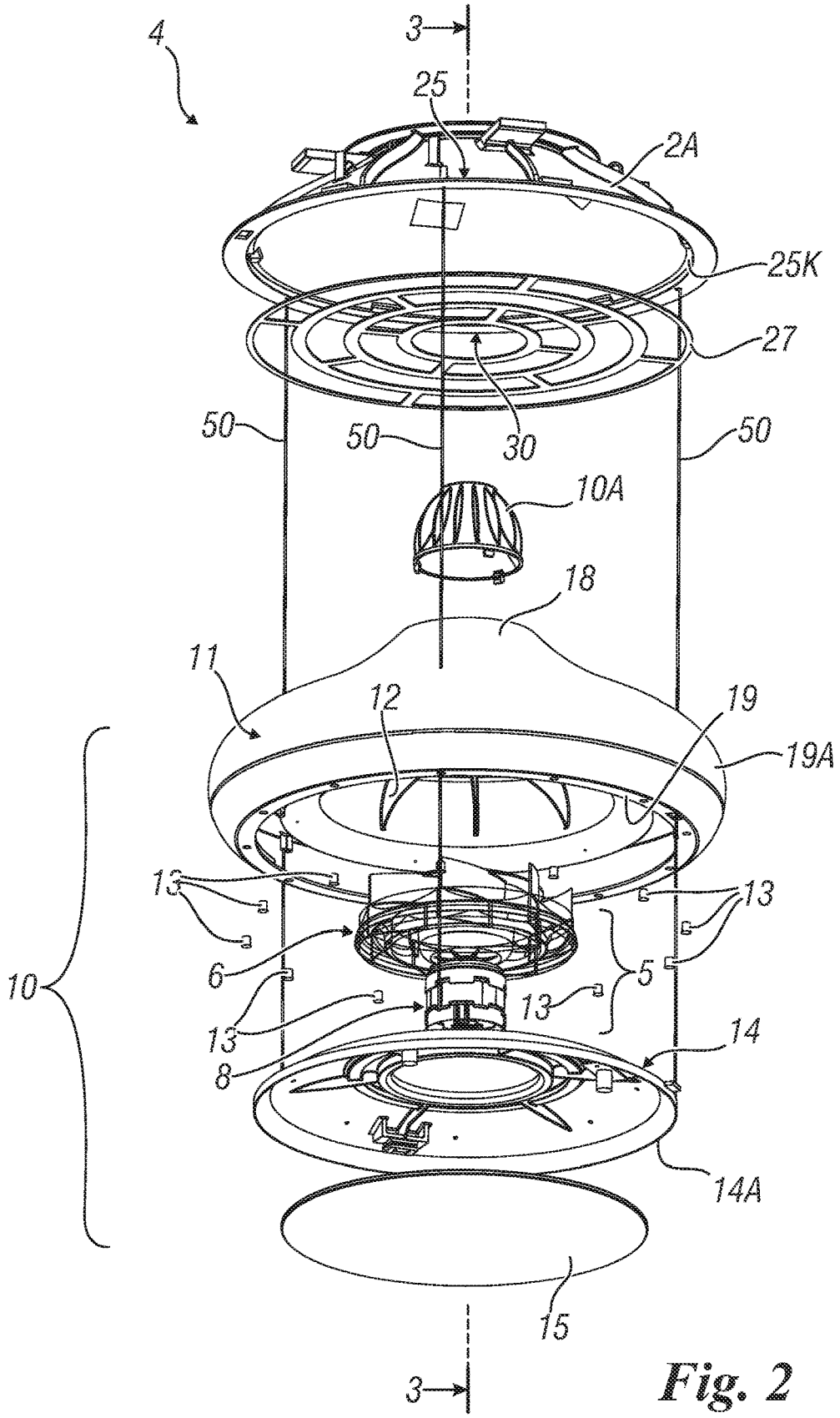
FIG. 2 shows a perspective exploded view of the hood in FIG. 1.
Figure 3:
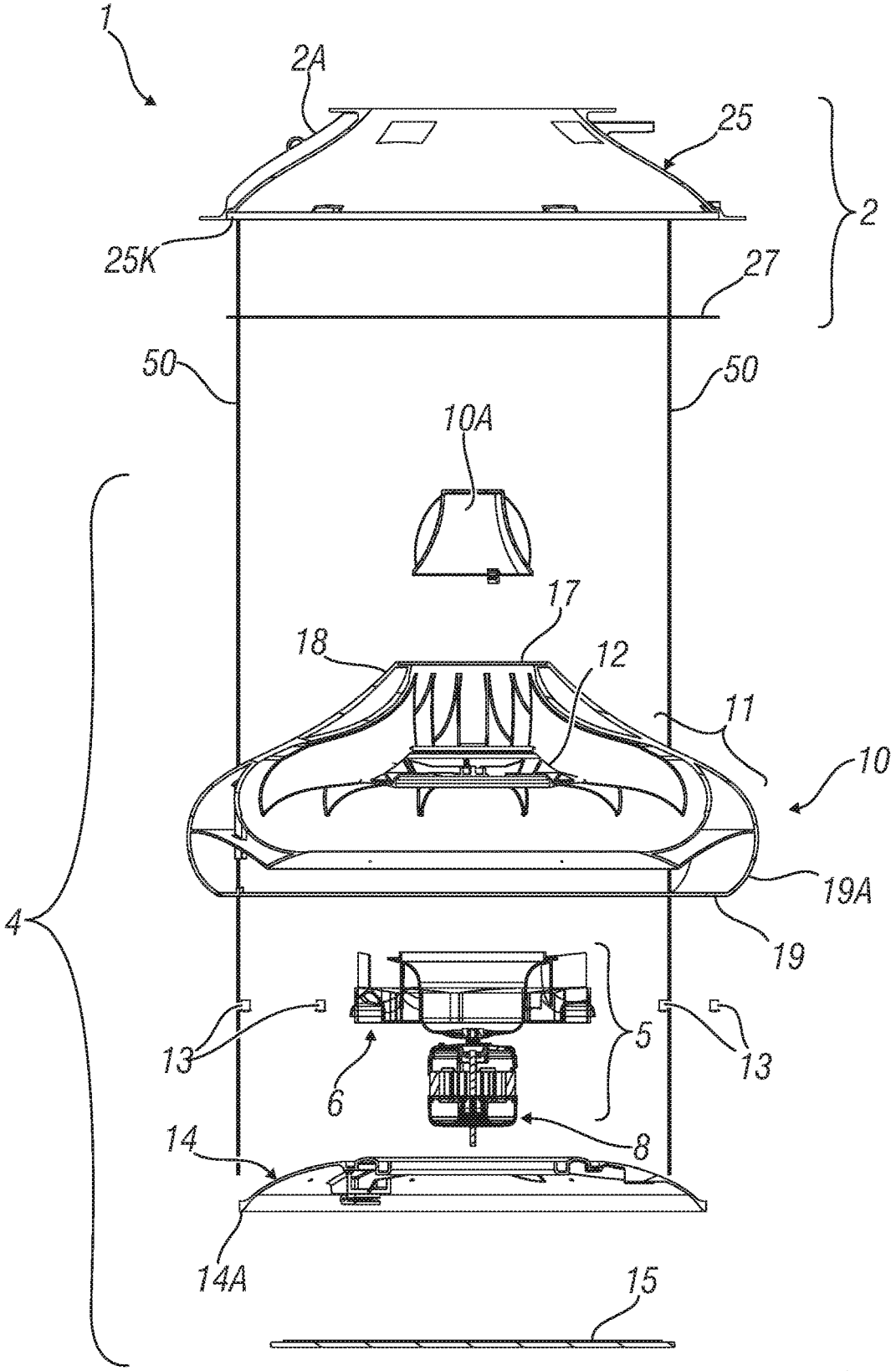
FIG. 3 shows a view along 3-3 in FIG. 2 with some parts omitted.

With reference to the above-mentioned figures, an extractor hood according to the invention is shown generally by 1. This hood comprises a first portion 2 integral with a wall 3 of the room in which is located a cooking surface (not shown) above which the above-mentioned hood is placed; the hood 1 comprises a second portion 4 capable of being arranged, while the hood is being used, close to the above-mentioned cooking surface. This second portion can be fixed, at a pre-defined distance from the first portion 2 or the second portion 4 can be movable in relation to the first so that the distance between these portions can be changed for example by bringing the second portion 4 close to the cooking surface when the food is being prepared and moving said portion 4 away from said surface when the latter is not being used.

The first portion 2 and the second portion 4 are connected together by cables 50. No tube or pipe for air is provided between the two portions.

If the second portion 4 is movable in relation to the first, conventional motorised winders connected to the first portion or to the wall 3 raise and/or lower the second portion 4 of the hood in relation to the cooking surface by acting on the cables 50.

The second portion 4 comprises a fan 5 having an impeller 6 connected to its own electric motor 8. This fan is inserted within a body 10 of portion 4 having an external part or casing 11 to which is connected a support 12 of the motor and to which is fixed a support 14 for a closing element 15 made, for example, of glass. In the support 14 is located a conventional filtering element (not shown).

Advantageously, the support 14 (not shown) is hinged to the casing 11 and is fixed to it in an easily removable way by a plurality of magnets 13. Clearly, this support can be fixed to the casing 11 by screws.

The closing element 15 has a smaller diameter than that of an opening 14A in the support 14 so as to create an annular extraction opening 4K around the element 15.

The fan 5 is a fan operating at low voltage (with an extraction power of, for example, between 200 and 600 $m^3/h$) and capable of extracting the fumes and/or vapours that are generated on the cooking surface (indicated by the arrows F in FIG. 4) mainly thanks to the fact that the body 4 that contains it is placed at a relatively short distance from said cooking surface. The extracted fumes and/or vapours are conveyed, after passing and being filtered through the filter in the body 10, into a substantially annular duct 16 defined by the outer casing 11 of the portion 4, by the support 12 of the motor 8 and by an insert 10A placed on the support 12; these fumes and/or vapours are directed towards an opening 17 at a second end 18 of said portion juxtaposed to an end opening 19 at a first end 19A of the second portion 4 through which the fumes and/or vapours F, passing through the opening 4K, are extracted by the fan 5. Clearly, the opening 19 of said first end 19A is larger than said closing element 15 so as to delimit, with the support 14, said extraction opening 4K.

Figure 4:
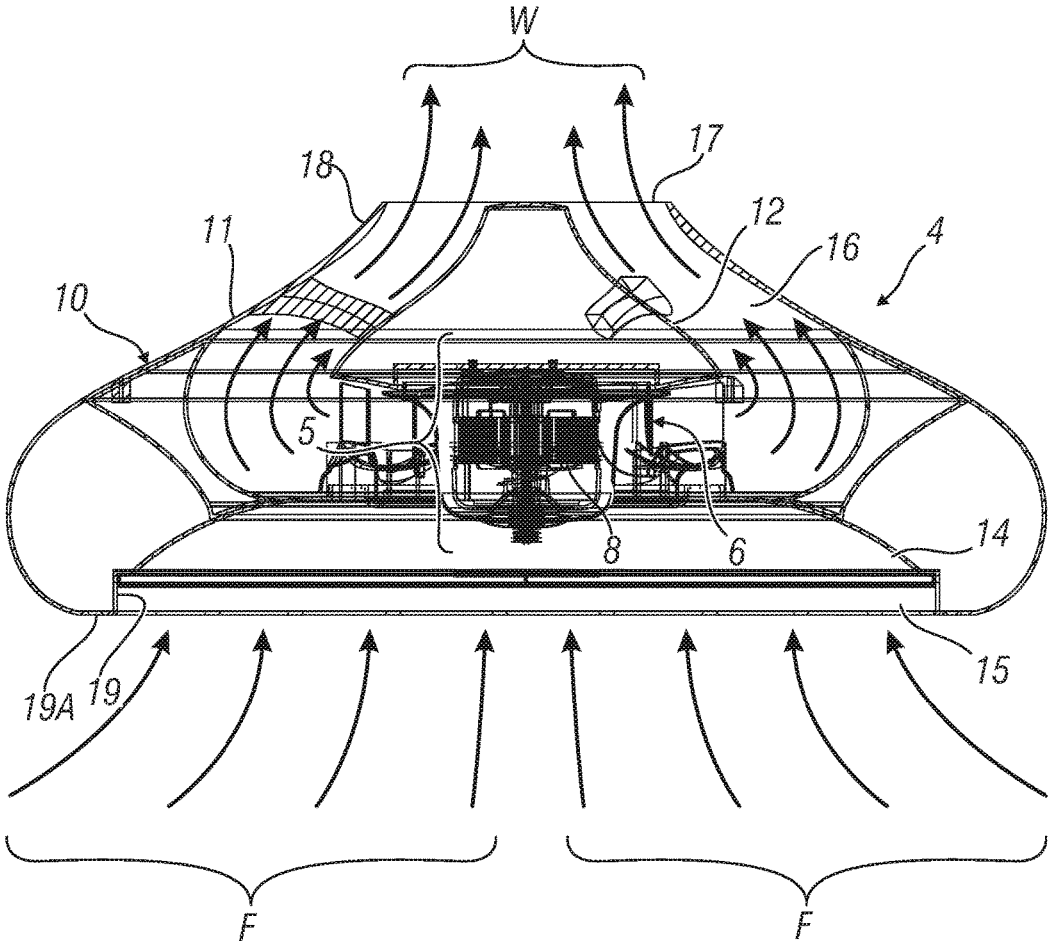
FIG. 4 shows a cross-sectional view of a portion of the extractor hood in FIG. 1 showing also the flows of air or rather fumes and/or vapours extracted from a cooking surface above which the hood is placed.
Figure 5:
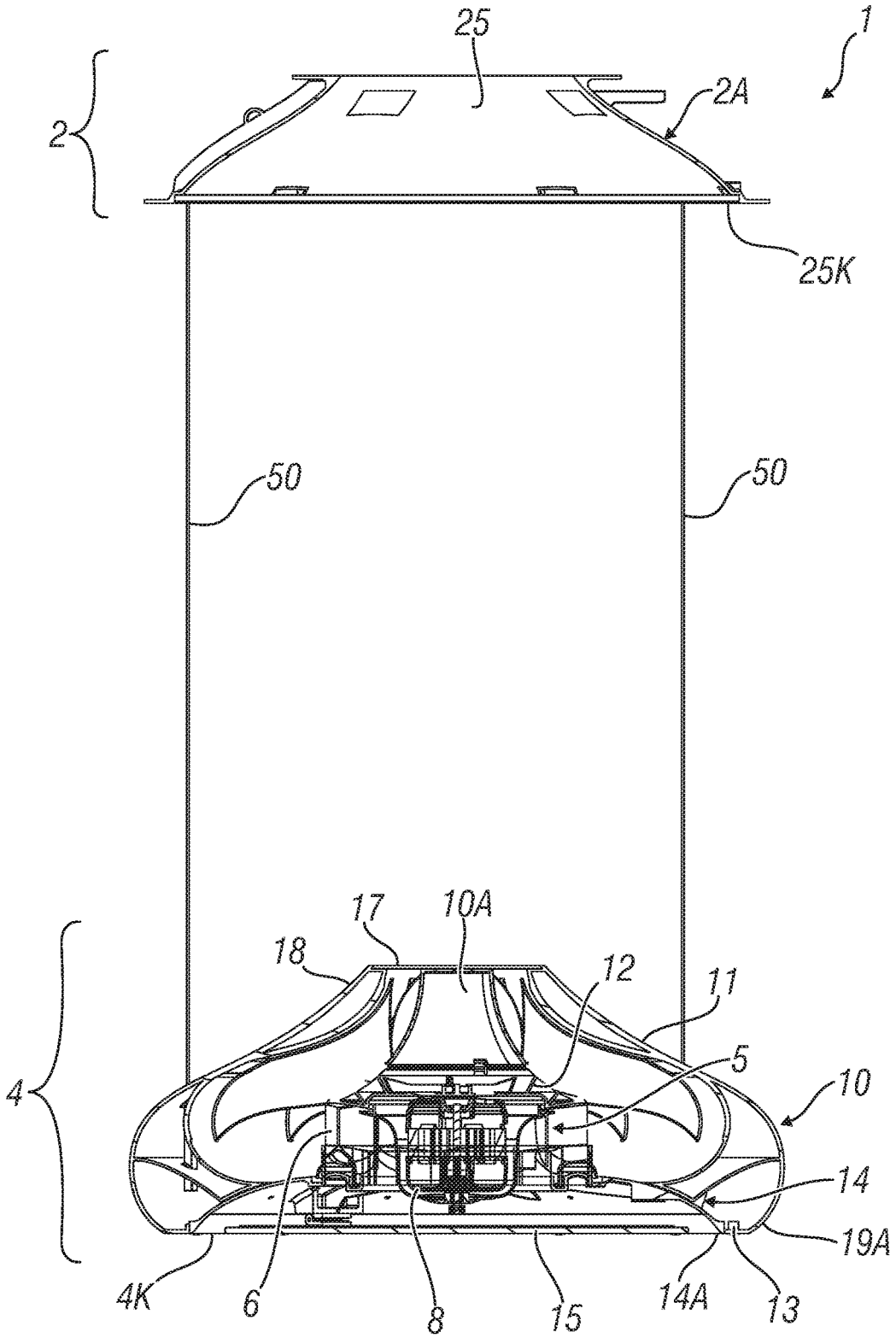
FIG. 5 shows a cross-sectional view along line 5-5 in FIG. 1.
Figure 6:
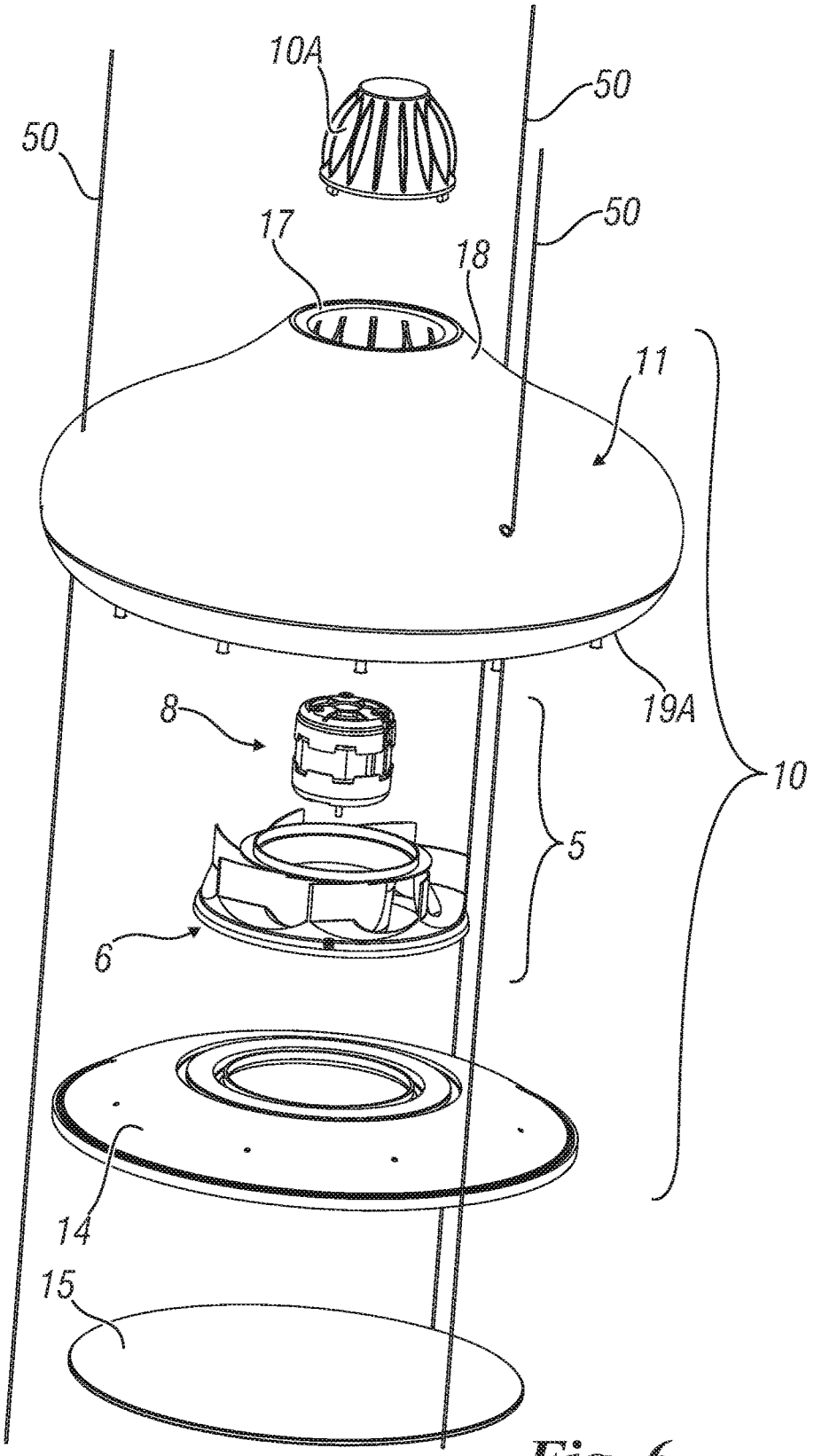
FIG. 6 shows an exploded schematic view of the portion of the hood shown in FIG. 4.

The air freely exiting from said opening 17, which in FIG. 4 is shown by the arrows W, is extracted (at a distance and with no flexible pipe connecting portions 2 and 4) by a fan (not shown) connected to the first portion 2 of the hood 1 fixed to the wall 3. This fan or ventilator has a high extraction power (for example between 600 and 1200 $m^3/h$) greater than that offered by the fan 5 connected to the second portion 4 of the hood 1. Thanks to this characteristic, the air W is quickly extracted towards the first portion of the hood 1 and is expelled therefrom into a duct (not shown) by which fumes and/or vapours extracted from the cooking surface are transferred to an environment outside the kitchen.

It should also be taken into account that the distance between portion 2 and the portion 4 of the hood 1 should be such as not to hamper the extraction function of the fan connected to portion 2: this distance is in fact within about 80 and about 130 cm (and preferably between 40 and 150 cm), a value that however allows an efficient action of the above-mentioned fan on the air W.

The fan of portion 2 is inserted in a body 25 of portion 2 and is moved by its own high-powered electric motor (not shown). The body 25 containing the above-mentioned fan is larger than the transverse dimension of the opening 17 of portion 4 of the hood 1 so as to ensure that all of the air exiting said opening is extracted towards the second portion 4. In particular, this body 25 has an opening 25K that is much larger than the opening 17 over which is placed a grill 27.

In the figures, the fan of portion 2 extracts the air W exiting the opening 17 of portion 4 towards an axially centered area 30 of portion 2. In a variation, portion 2 has an area for the extraction of air W that is annular in shape or arranged near a lateral wall 2A of said portion.

Obviously, portion 2 can have any conformation and have the seats or cavities or passages for the air W conformed in any way, but in any case arranged so as to surround, projecting (or completely overlapping), the opening 17 of portion 4 so as to be able to extract all of the air exiting said opening.

Precisely because the motor 8 of the fan 5 is a low-powered low-voltage motor, it is supplied through at least one of the cables 50 that carry a low-voltage power to said motor. For this reason, these cables have a very small cross-section, which means that they are not very visible from a distance. This characteristic, which is added to the fact that the hood has no pipe or duct between portions 2 and 4, offers an aesthetic advantage to hood 1 compared to known similar hoods, in that the hood according to this invention comprises the second portion 4 which, from a distance, can appear not to be supported by the first portion 2.

The hood according to the invention moves the "main" extraction arrangement into a first fixed portion 2 of the hood, leaving in the second portion 4 (possibly movable) an extraction arrangement of lower power (but still sufficient to remove the fumes and/or vapours from the cooking surface) that can be powered at low voltage through wires with a small cross-section. This allows the above-mentioned aesthetic effect to be achieved.

Various embodiments of the invention have been described. Others are, however, possible and can be obtained by the teachings of the preceding description. Other solutions are also to be deemed to fall within the scope of the invention as defined by the following claims.

The invention claimed is:

1. An extractor hood for extracting at least one of fumes or vapours generated on a cooking surface, said extractor hood comprising:

a first portion (2) adapted to be affixed to a wall (3) of a room where said cooking surface is located, a second portion (4), spaced apart from the first portion (2) and positioned closer to the cooking surface than the first portion, and a support connection (50) that secures said first portion (2) to the second portion (4), said second portion containing a fan (5) that is adapted to extract at least one of fumes or vapours from the cooking surface when the extractor hood (1) is in use, said first portion (2) comprising an autonomous fan capable of extracting at least one of fumes or vapours exiting the second portion (4) via the fan (5), and said extractor hood having no tube or duct for air that connects the first portion (2) and the second portion (4).

2. The extractor hood according to claim 1, wherein the autonomous fan of the first portion (2) has a greater extraction power than the fan (5) of the second portion (4).

3. The extractor hood according to claim 1, wherein the second portion (4) is movable in relation to the first portion (2), such that the second portion (4) is moveable away from or closer to the first portion (2) depending on whether or not the extractor hood is being used.

4. The extractor hood according to claim 3, further comprising a motor drive that moves the support connection (50) between the second portion and said first portion or the wall (3) to which said first portion is fixed, said motor drive changing a length of said support connection so as to vary the distance between the first portion (2) and the second portion (4).

5. The extractor hood according to claim 1, wherein the second portion (4) has an annular end opening (4K) provided at a first end (19A) through which the at least one of fumes or vapours are extracted from the cooking surface by the fan (5), and a second opening (17) located at a second end (18) of the second portion (4) through which at least one of fumes or vapours are expelled from said second portion (4).

6. The extractor hood according to claim 1, wherein the fan (5) in the second portion (4) comprises an electrically powered motor (8).

7. The extractor hood according to claim 5, wherein the second portion (4) supports a closing element (15) and contains a filter for said at least one of fumes or vapours at said first end opening (4K) of the first end (19A) of the second portion (4), said closing element (15) being smaller than an opening (19) of said first end so as to create an annular extraction opening (4K), and being provided with an internal duct (16) within said second portion (4) that is connected to said second opening (17) and adapted to receive at least one of fumes or vapours filtered and extracted by the fan (5) inside said second portion (4) and to send said at least one of fumes or vapours to said second opening.

8. The extractor hood according to claim 7, wherein said internal duct (16) of said second portion (4) is annular and is defined by an external casing (11) of said second portion (4), by a support (12) of the fan (5) inside the second portion (4), and by an insert (10A) placed on said support (12).

9. The extractor hood according to claim 5, wherein the extraction device of the first portion (2) is placed in an axial position above the second opening (17) of the second portion (4).

10. The extractor hood according to claim 1, wherein the first portion (2) has an annular duct capable of receiving at least one of fumes or vapours exiting the second portion (4), that is operationally connected to an extraction device including the autonomous fan inside said first portion (2).

11. The extractor hood according to claim 1, wherein an extraction device including the autonomous fan inside the first portion (2) has a high extraction power of between 600 and 1200 $m^3/h$.

12. The extractor hood according to claim 1, wherein the support connection (50) comprises cables of which at least one cable carries an electrical supply to the fan (5) of the second portion (4), and the fan of the second portion is a low-voltage fan.

* * * * *